US010736353B1

(12) United States Patent
Sharp

(10) Patent No.: US 10,736,353 B1
(45) Date of Patent: Aug. 11, 2020

(54) CIGAR CUTTER

(71) Applicant: Integral Logistics, LLC, Tamarac, FL (US)

(72) Inventor: Rosemary Y. Sharp, Tamarac, FL (US)

( * ) Notice: Subject to any disclaimer, the term of this patent is extended or adjusted under 35 U.S.C. 154(b) by 0 days.

(21) Appl. No.: 16/525,655

(22) Filed: Jul. 30, 2019

(51) Int. Cl.
*A24F 13/26* (2006.01)

(52) U.S. Cl.
CPC ..... *A24F 13/26* (2013.01)

(58) Field of Classification Search
CPC ..... A24F 13/20; A24F 13/24; A24F 13/26
USPC ..... 30/109–113, 241–244; D27/195; 131/248–252
See application file for complete search history.

(56) References Cited

U.S. PATENT DOCUMENTS 862,386 A * 8/1907 Brunhoff et al. ..... A24F 13/24 30/109
894,256 A * 7/1908 Ciner ..... A24F 13/24 131/251
943,738 A * 12/1909 Fischer ..... A24F 13/24 30/109
964,561 A * 7/1910 Salviolo ..... A24F 13/24 30/109
RE27,558 E * 1/1973 Phelps et al. ..... A47B 51/00 312/272
3,903,598 A * 9/1975 Lefebvre ..... A24F 13/26 30/112
4,536,024 A * 8/1985 Gabriel ..... B64D 1/22 294/82.24
5,345,952 A * 9/1994 Nielander ..... A24F 13/20 131/235.1
D396,326 S * 7/1998 Makrinos ..... D27/195
D455,521 S * 4/2002 Park ..... D27/195
6,695,191 B1 * 2/2004 Tabeling ..... G02B 6/25 225/103
6,708,409 B2 * 3/2004 Yu ..... A24F 13/26 131/253
8,656,595 B2 * 2/2014 Wong ..... A24F 13/26 30/109
9,883,694 B2 * 2/2018 Almsberger ..... A24F 13/26
D822,274 S 7/2018 Almsberger et al.
D822,275 S 7/2018 Almsberger et al.
2007/0089299 A1 * 4/2007 Belaubre ..... A24F 13/26 30/112
2009/0113719 A1 * 5/2009 Smith ..... A24F 13/26 30/113
2015/0321891 A1 * 11/2015 Mohr ..... B66F 7/065 254/122

* cited by examiner

*Primary Examiner* — Ghassem Alie
*Assistant Examiner* — Bharat C Patel
(74) *Attorney, Agent, or Firm* — Frank Marino

(57) ABSTRACT

A cigar cutting apparatus has a circular body with a front housing and a rear housing, a left cutting blade assembly, a right cutting blade assembly, a blade opening actuator. A scissors mechanism communicates between the actuator and the blade assemblies and is adapted to retain the blade assemblies in the closed state and to selectably allow the blade assemblies to move to the open state. The front housing has a cigar-receiving through-hole and the rear housing has a cigar-impeding closed back wall.

5 Claims, 6 Drawing Sheets

CIGAR CUTTER

FIELD OF THE INVENTION

The invention is related to cigar cutting apparatuses. More specifically, the invention is related to cigar cutters having facility to retain the clipped end of a cigar until it can be conveniently disposed of.

BACKGROUND OF THE INVENTION

There is an ever-increasing need to improve the cutting of cigar tips to prepare the cigars for smoking. Cigars are rolled within a smooth wrapper leaf to hold the ground flavor leaves in form and to provide an aesthetic look and feel. While the wrapper leaf is typically removed at the burning end by slicing at the factory, the wrapper leaf is left covering the mouth end to allow the user to prepare the mouth end according to his own preference. Of course, the non-porous wrapper leaf at the mouth end must be breached to allow the user to suck smoke through the cigar.

Such preparation typically falls within two types; punching and slicing. Punching is accomplished by pushing a cylindrical cutter longitudinally into the mouth end of the cigar and removing a "plug" to create a hole through the wrapper at the mouth end. Slicing is accomplished by pushing one or more sharp blades transversely across the mouth end of the cigar to remove the tip. This tip creates an inconvenience . . . the sliced-off tip falls from cutter and must either be caught by the user and discarded or else it will fall to the floor, creating litter and worse.

In using most two-blade cigar slicing cutters, such as those shown in U.S. Pat. No. 9,883,694, the user holds the cutter in one hand and the cigar in the other. He first opens the cutter to create a gap between the blades with the hand holding the cutter. Then he puts the mouth end of the cigar between the open blades with his other hand. Then he forces the blades closed with his first hand causing them to slice through the cigar and remove the tip. Because both hands are occupied, the tip falls to the floor or onto a nearby table or other furnishing. He apologizes to anyone who may have been struck by it or witnessed the offense, and bends down to retrieve it for disposal, leaving flakes of tobacco behind.

Further, prior art two-blade cutters typically include a mechanism for synchronizing the blades. There are meant to ensure that both of the opposing blades open and close equally, oppositely, and simultaneously. But such mechanisms are fraught with complication and expense and are found to be short-lived and prone to failure. For instance, the mechanism of the cuter shown in U.S. Pat. No. 9,883,694 includes a gearing system including a ring gear and three spur gears. The forces required during cigar cutting eventually overcome the strength of the gear teeth and some get broken off or worn. This disrupts the synchronization of the blades and leads to the inability to fully close the cutter. One blade remains slightly extended when the other has reached its closed position. And the blades become nonsymmetrical such that the cutter can no longer receive fatter cigars.

There exists a need for, and it is an object of the invention to provide, a slicing cigar cutter which captures the cut-off tip and retains it within the cutter for disposal at the user's convenience. There also exists a need for, and it is an additional object of the invention to provide, a slicing cigar cutter with a simplified, less expensive-to-manufacture, and more reliable operating mechanism.

Additional needs and objects of the invention may become apparent upon review of the included disclosure.

SUMMARY OF THE INVENTION

The invention may be embodied in or practiced using a slicing cigar cutter having a simpler and more reliable blade synchronization mechanism, which is less expensive to manufacture, and having a compartment for receiving and storing the cut-off cigar tip for later disposal. The cutter allows the user to operate the slicing mechanism, receive and cut the cigar, and retain the cut-off tip for later disposal all with the use of one hand.

The invention may be embodied in or practiced using a cigar cutting apparatus having a circular body with a front housing and a rear housing, a left cutting blade assembly, and a right cutting blade assembly. The front housing may have a cigar-receiving through-hole and the rear housing may have a cigar-impeding closed back wall. The left and right cutting blade assemblies may be movable relative to the circular body between an open state in which both blade assemblies are extended outwardly and a closed state in which both blade assemblies are compressed inwardly. The blade assemblies may be biased towards the open state. The left and right cutting blade assemblies may include blades having inwardly-directed cutting edges, and during the open state the cutting edges may be extended apart sufficiently to receive a cigar end therebetween. The left and right cutting blades may be adapted so that forcing them inwardly toward the closed state causes the cutting edges to intersect the cigar end therebetween and remove a cigar end tip therefrom.

The apparatus may have a chamber between one of the left and right cutting blade assemblies and the closed back wall during the closed state for receiving and retaining the cigar end tip. The apparatus may have a blade opening actuator and a scissors mechanism communicating between the actuator and the blade assemblies and adapted to retain the blade assemblies in the closed state and to selectably allow the blade assemblies to move to the open state. The scissors mechanism may include a pair of links in an "X" arrangement pivotably affixed to the body, engageable by the actuator, and having lower pawl ends for engaging the blade assemblies. The scissors mechanism may be adapted such that actuation of the actuator allows the lower pawl ends to engage the blade assemblies and retain them in the closed state. The blades may include stops to be engaged by the lower pawl ends to retain the blade assemblies in the closed state. Each cutting edge may be a curved beveled edge.

The invention may further be embodied in or practiced using a cigar cutting apparatus having a circular body with a front housing and a rear housing, a left cutting blade assembly, and a right cutting blade assembly. The front housing may have a cigar-receiving through-hole. The left and right cutting blade assemblies may be movable relative to the circular body between an open state in which both blade assemblies are extended outwardly and a closed state in which both blade assemblies are compressed inwardly. The blade assemblies may be biased towards the open state. The left and right cutting blade assemblies may include blades having inwardly-directed cutting edges, and during the open state the cutting edges may be extended apart sufficiently to receive a cigar end therebetween. The left and right cutting blades may be adapted so that forcing them inwardly toward the closed state causes the cutting edges to intersect the cigar end therebetween and remove a cigar end tip therefrom.

The apparatus may have a blade opening actuator and a scissors mechanism communicating between the actuator and the blade assemblies and adapted to retain the blade assemblies in the closed state and to selectably allow the blade assemblies to move to the open state. The scissors mechanism may include a pair of links in an "X" arrangement pivotably affixed to the body, engageable by the actuator, and having lower pawl ends for engaging the blade assemblies. The scissors mechanism may be adapted such that actuation of the actuator allows the lower pawl ends to engage the blade assemblies and retain them in the closed state.

The invention may further be embodied in or practiced using a cigar cutting apparatus having a circular body with a front housing and a rear housing, a left cutting blade assembly, a right cutting blade assembly, a blade opening actuator, and a scissors mechanism. The left and right cutting blade assemblies may be movable relative to the circular body between an open state in which both blade assemblies are extended outwardly and a closed state in which both blade assemblies are compressed inwardly. The scissors mechanism may communicate between the actuator and the blade assemblies and may be adapted to retain the blade assemblies in the closed state and to selectably allow the blade assemblies to move to the open state. The front housing may have a cigar-receiving through-hole and the rear housing may have a cigar-impeding closed back wall.

Further features will be made apparent upon a review of the following description and drawings of an exemplary embodiment.

DETAILED DESCRIPTION OF THE EXEMPLARY EMBODIMENTS

Figure 1:
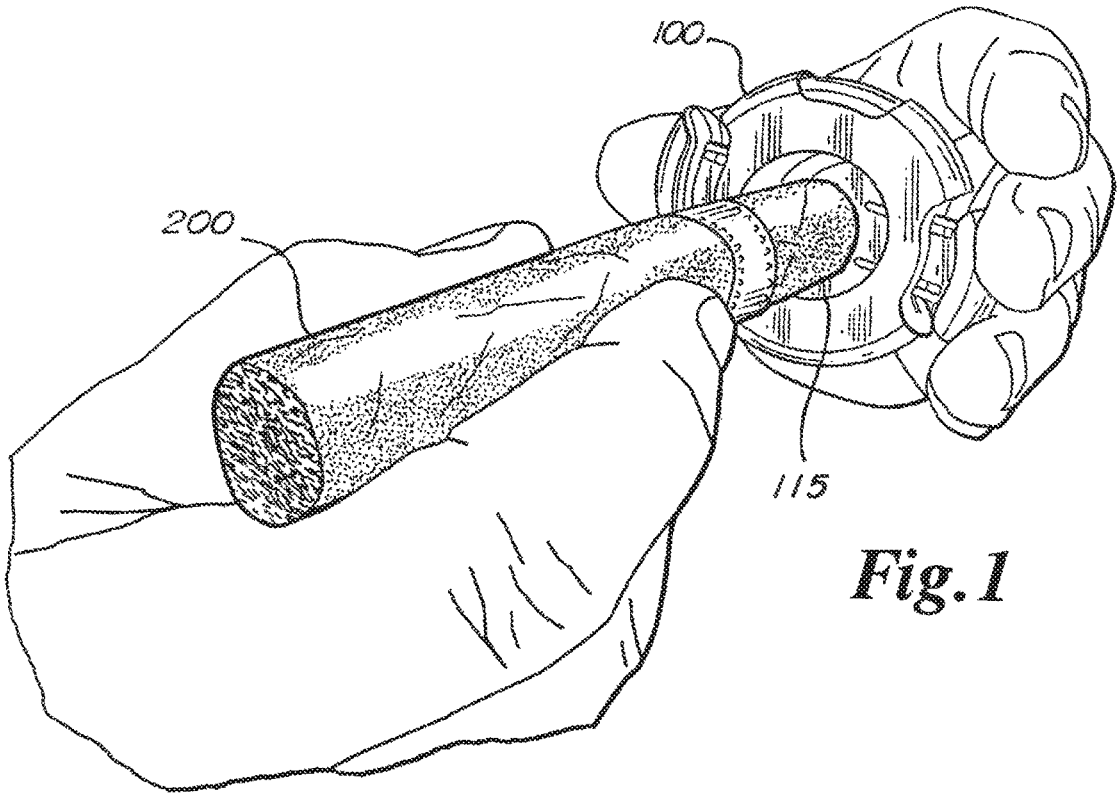
FIG. 1 is a perspective view of a cigar cutter according to an exemplary embodiment of the invention slicing a cigar.
Figure 2:
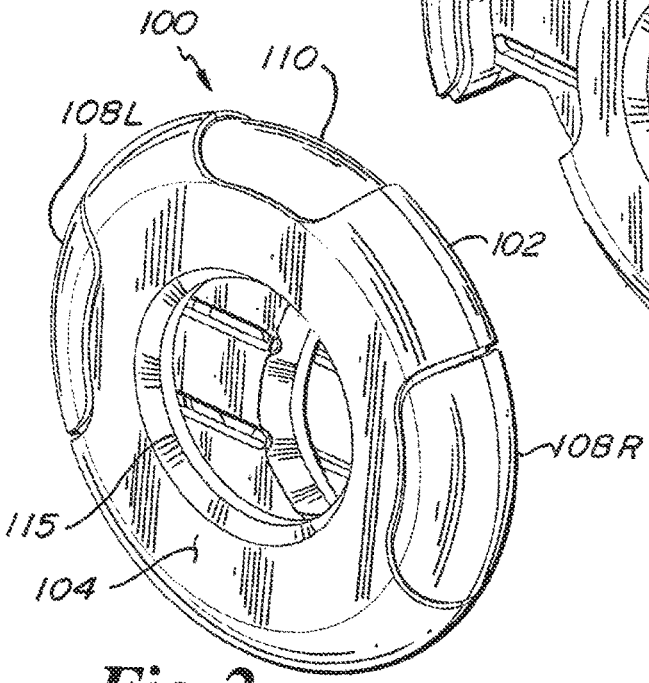
FIG. 2 is a perspective front view of the cigar cutter of FIG. 1 in its closed state.
Figure 3:
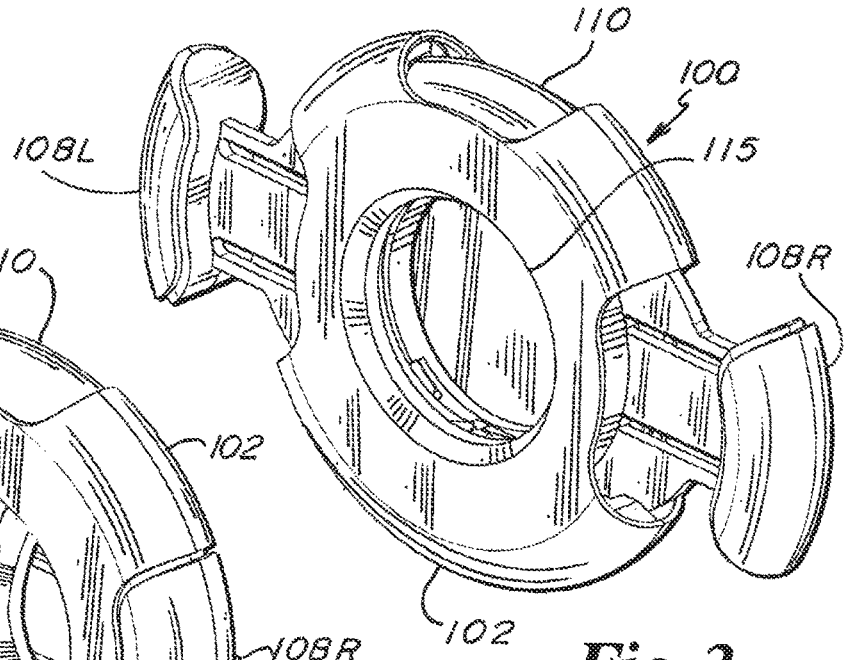
FIG. 3 is a perspective front view of the cigar cutter of FIG. 1 in its opened state.
Figure 4:
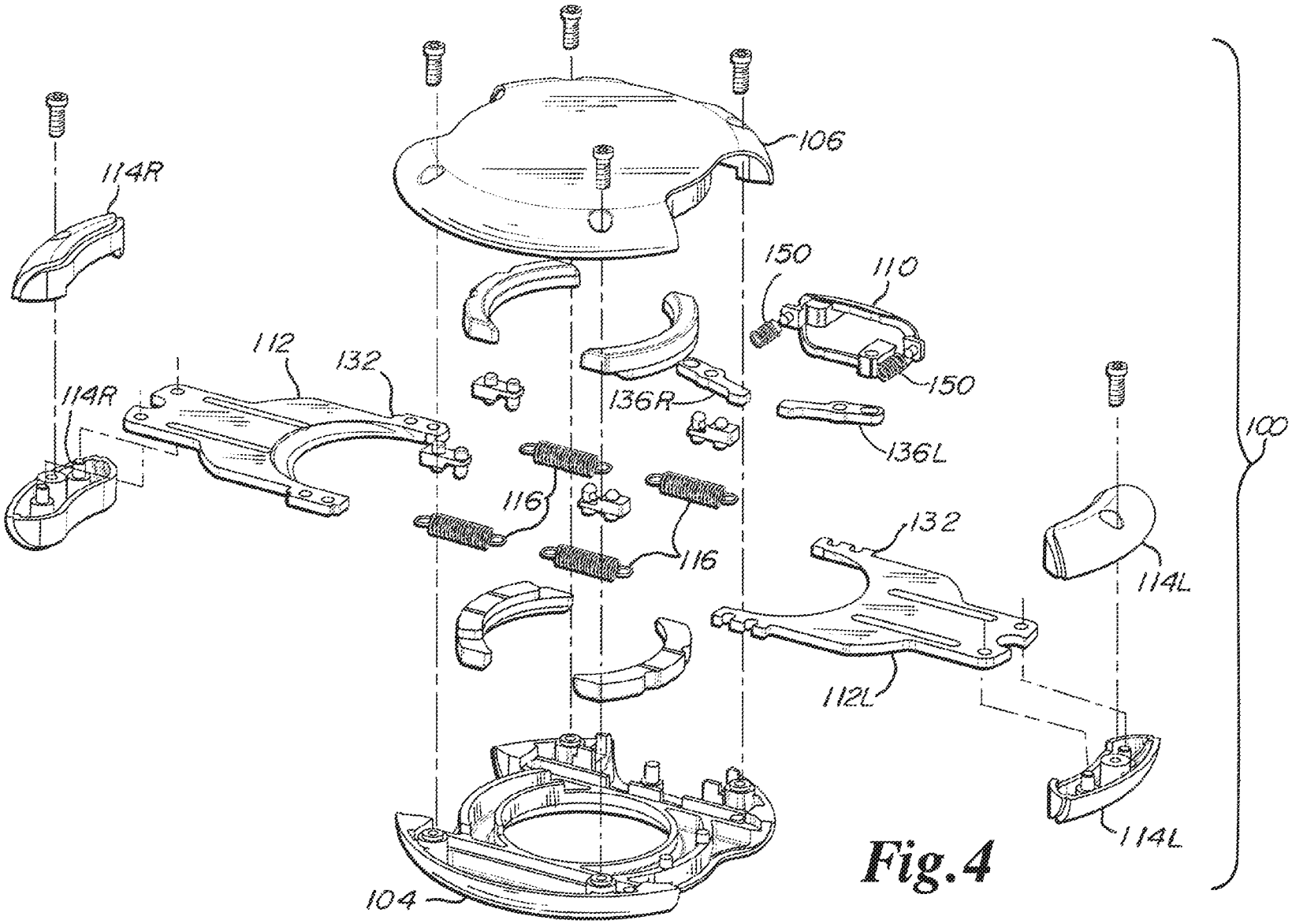
FIG. 4 is an exploded view of the cigar cutter of FIG. 1.

FIGS. 1 through 10 depict a cigar cutter 100 according to an exemplary embodiment. The cutter has a circular body 102 having a front housing 104 and a rear housing 106, a left cutting blade assembly 108L, a right cutting blade assembly 108R, and a blade opening actuator 110. The left and right cutting blade assemblies each include a steel blade 112L and 112R respectively, and a button 114L and 114R respectively. The blades and buttons are rigidly affixed together. It should be noted that the front housing has a cigar-receiving through-hole 115 while the rear housing has a cigar-impeding closed back wall 117.

Figure 5:
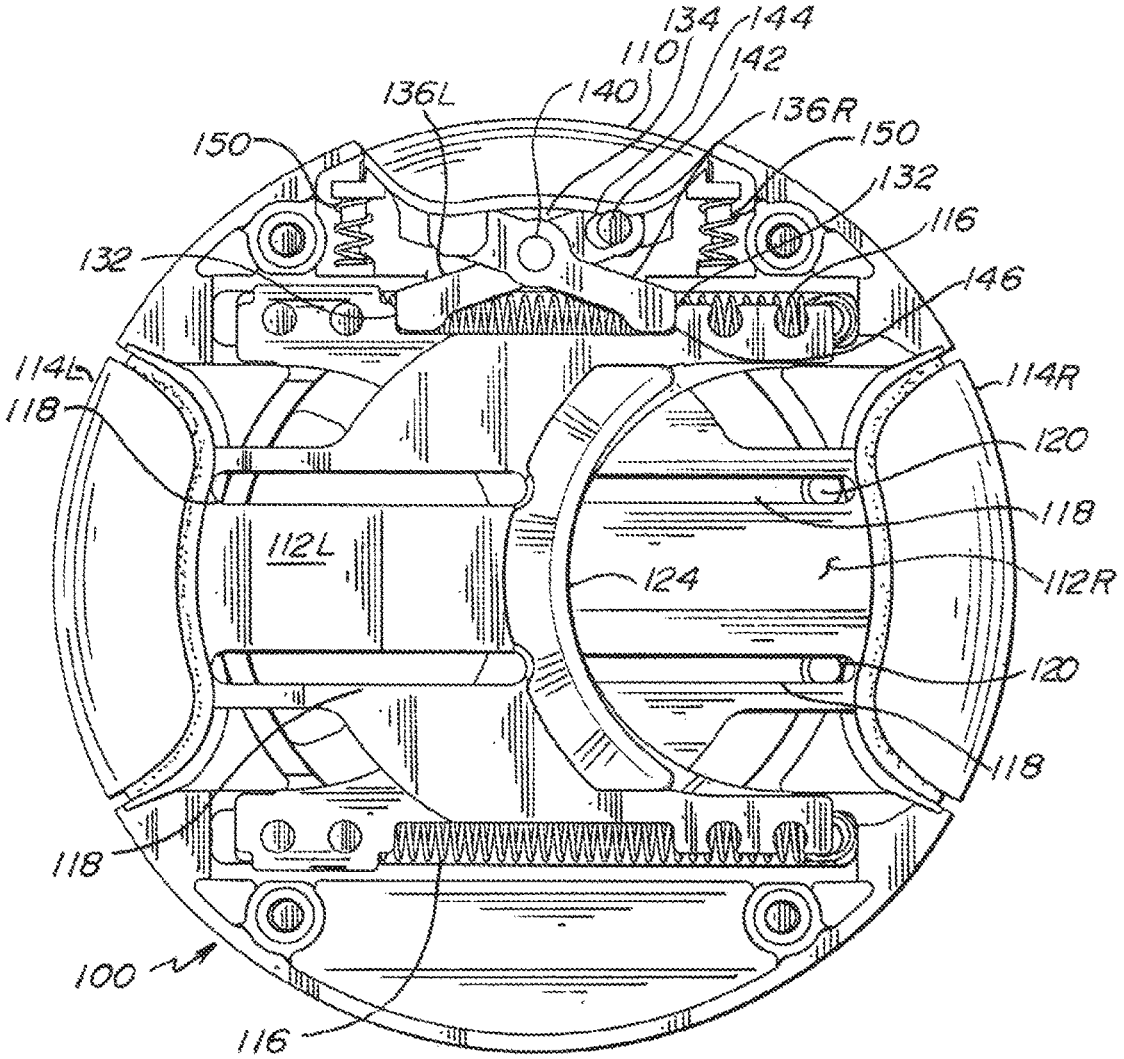
FIG. 5 is a frontal view of the cigar cutter of FIG. 1 in its closed state with its front housing removed.
Figure 6:
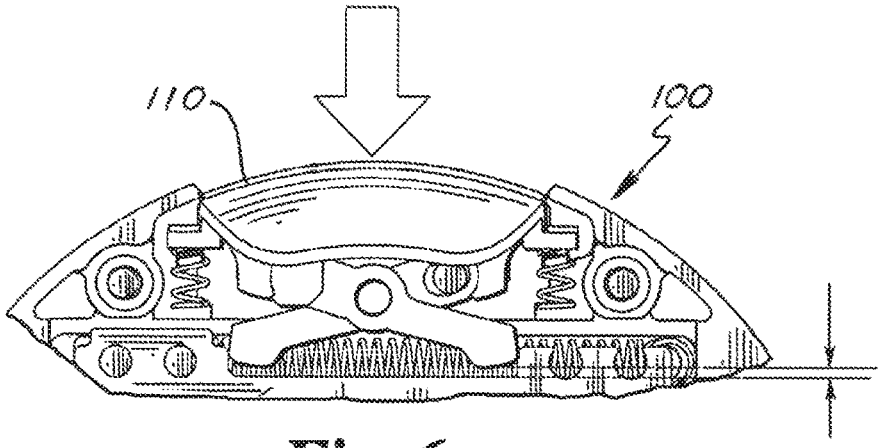
FIG. 6 is a frontal frontal view of the cigar cutter of FIG. 1 with its front housing removed as it is initially activated towards its opened state.
Figure 7:
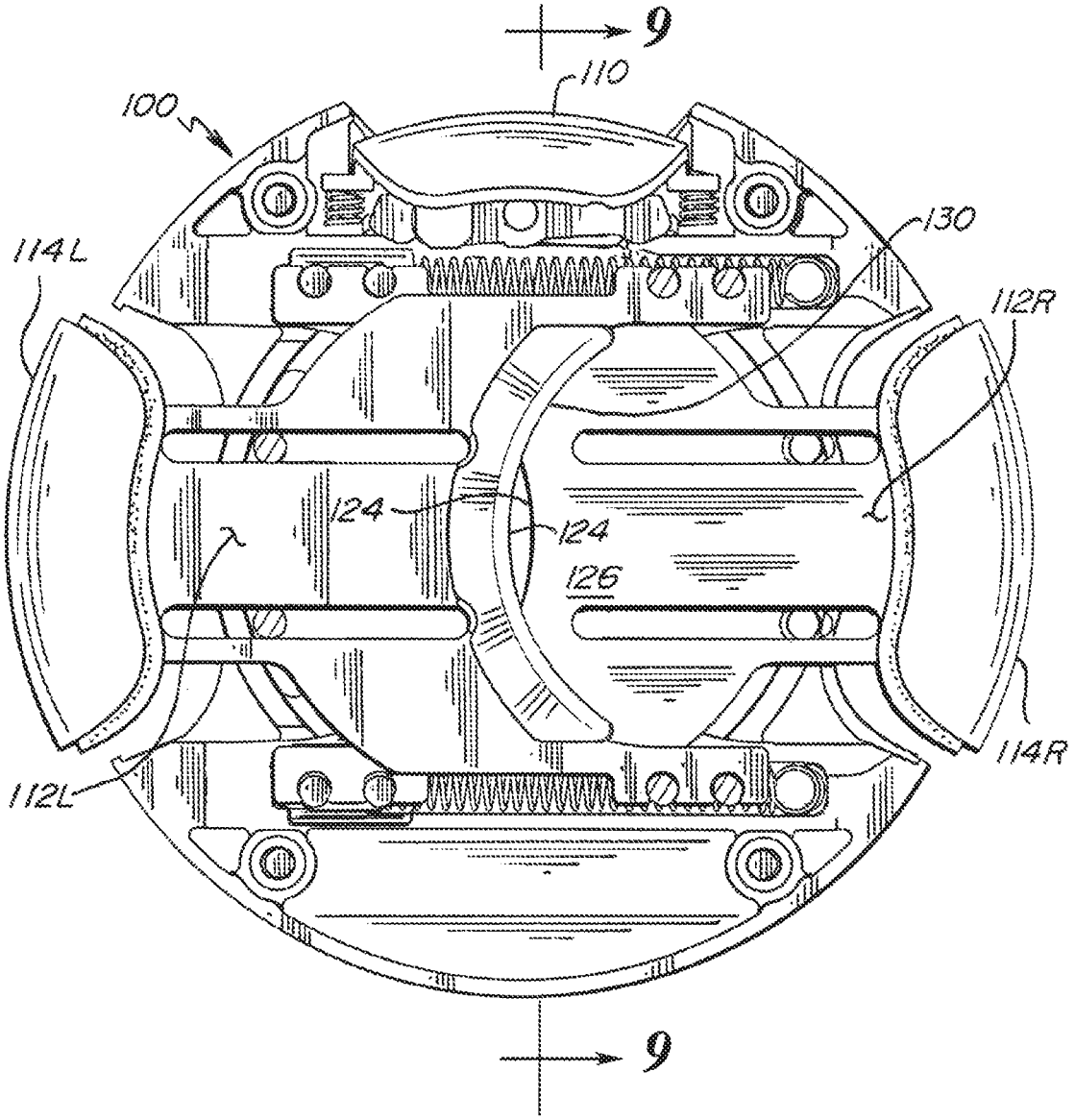
FIG. 7 is a frontal view of the cigar cutter of FIG. 1 with its front housing removed as it is activated more towards its opened state.
Figure 8:
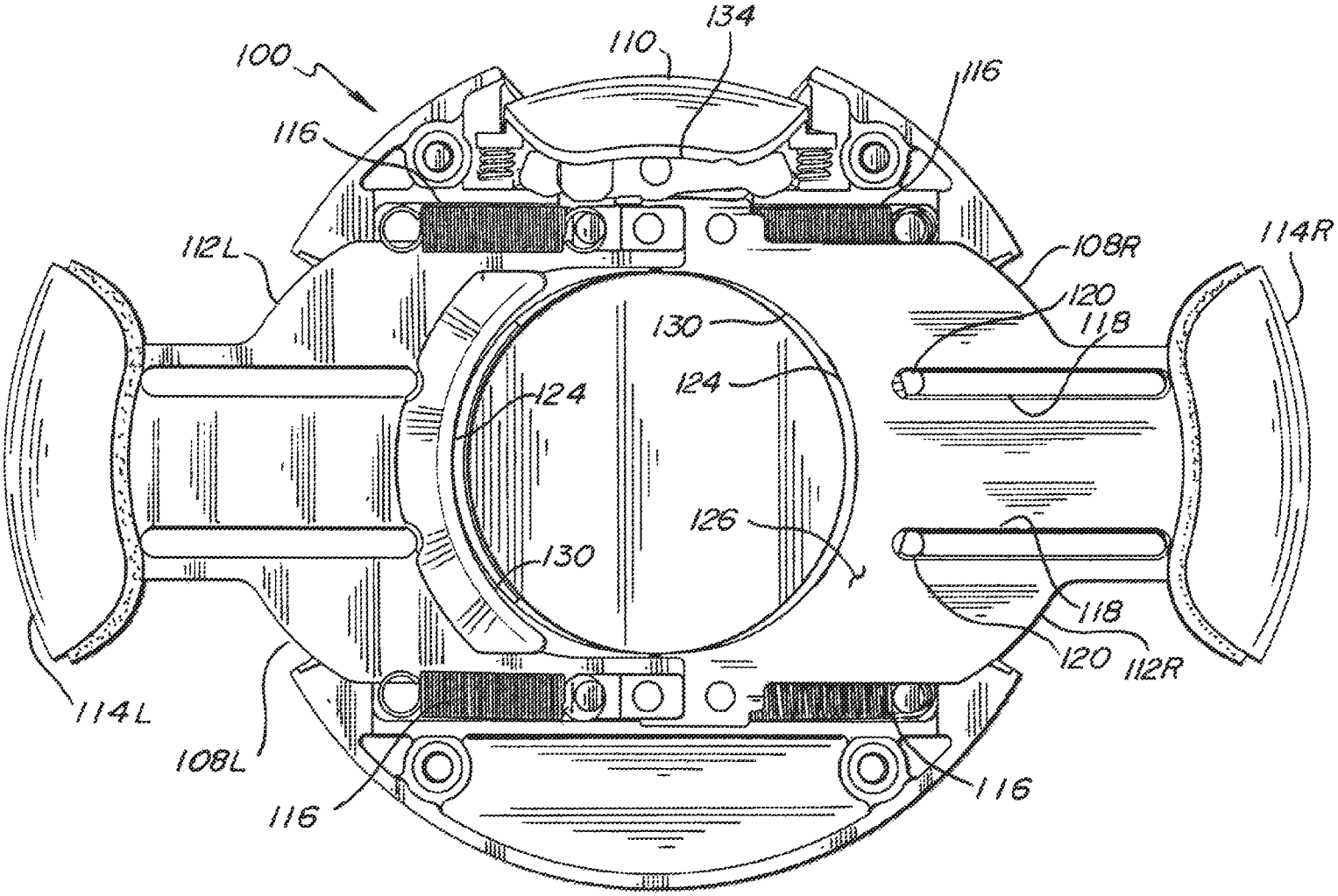
FIG. 8 is a frontal view of the cigar cutter of FIG. 1 in its opened state with its front housing removed.

The left and right cutting blade assemblies are transversely movable between the closed position shown in FIG. 5 and the opened position shown in FIG. 8, and are biased towards their opened positions by extension springs 116, which act between the body and the blades. The upper and lower extensions springs associated with the right cutting blade assembly are connected between the right blade and the rear housing and the extension springs associated with the left cutting blade assembly are connected between the left blade and the front housing. The blades include slots 118 which slidingly engage posts 120 of the front and rear housings and are adapted to slide smoothly between the front and rear housings, having only minimal front to rear looseness so that as they slide, the cutting edge 124 of each blade is kept in contact with the cutting surface 126 of the other blade The cutting surface of each blade is preferably planar and the cutting edge is preferably a curved beveled edge tapering from the outside surface 128 of the blade to a sharp curved line 130 on its cutting surface. The blade configuration could be altered while remaining within the intended scope of the invention. For instance, the cutting edges could be V-shaped or serrated, or one could be a straight knife edge while only the other could be curved, serrated, or V-shaped.

The blades include stops 132 which, as seen in FIG. 5, are used in the retainment of the blade assemblies in their closed positions against the bias of the extension springs. Scissors mechanism 134 communicates between blade opening actuator 110 and the blades. The scissors mechanism comprises two links 136 L and 136R which are pivotably connected together at and around pin 140, which is rigidly integrated in the body. The top ends of the links are movably connected to actuator 110 by pins 142 of the actuator riding in slots 144 of the links. Downward movement of the actuator thus causes the scissors links' "X" relationship to broaden, thereby lifting the lower pawl ends 146 of each of each link out of engagement with the blades, allowing the aforementioned extension springs to force the blade assemblies outwardly toward and to the opened state.

The actuator is biased upwardly by compressions springs 150 which act between the actuator and the body. The results not only in the actuator returning to its upward position when released, but in the actuator pulling with it the Scissors mechanism toward is original narrower "X" shape. While the blade assemblies are fully opened, the lower pawl ends of the links cannot drop fully down to their original positions but are biased against the top surfaces of the blade stops. As the blade assemblies are pushed in, such as during the later described cutting process, the stops pass the pawl ends and the pawl ends are able and caused to drop fully down by the force of the compression springs to their original positions, thereby engaging the stops and retaining blades inwardly in the closed state of FIG. 5 again.

Figure 9:
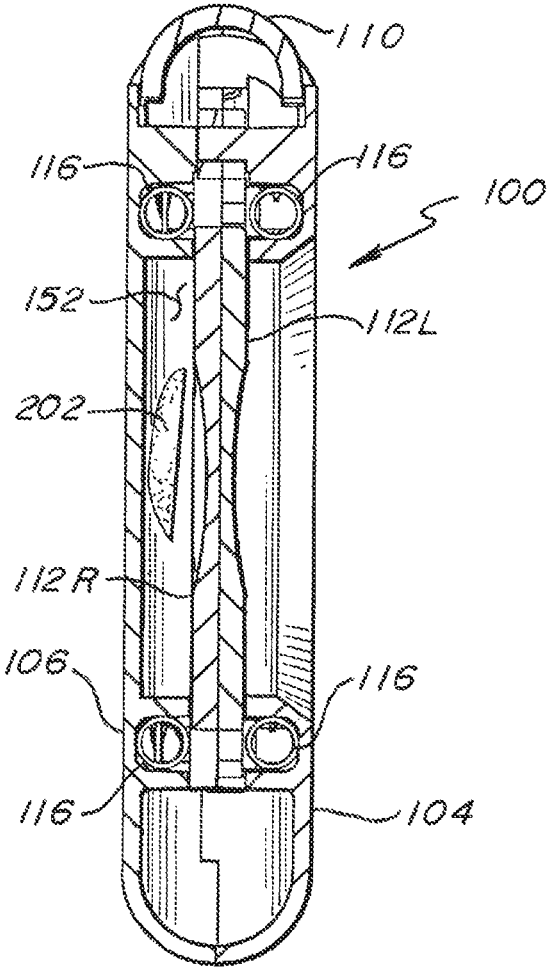
FIG. 9 is a side cross-sectional view through the cigar cutter of FIG. 1.
Figure 10:
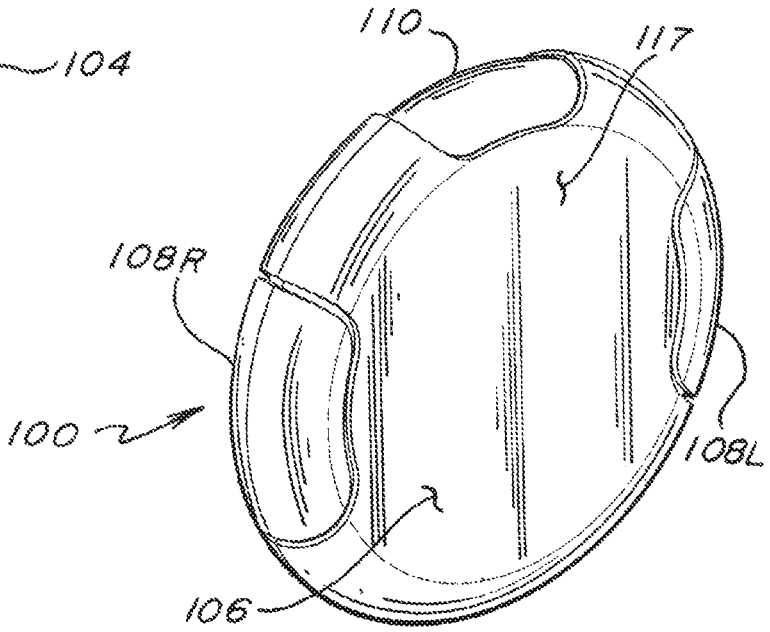
FIG. 10 is a perspective rear view of the cigar cutter of FIG. 1 in its closed state.

To cut a cigar 200, the user takes the closed cutter in his first hand and the cigar in the other. He presses the actuator to allow the cutter to open to its opened state. He inserts the mouth end of the cigar through the through-hole of the front housing, passed the blades, and until it rests against the back wall of the rear housing. He then squeezes inwardly the buttons of the blade assemblies, then causes the cutting edges of the blades to pass through the cigar and remove the unwanted tip 202. As the blade assemblies reach their most inward closed position the tip is trapped in the chamber 152 formed behind the blades and between the blades and the back wall, as seen in FIG. 9. The distance between the back side of the blades and the front side of the back wall. Being the depth of the chamber, is ideally approximately an eight of an inch so that when the cigar is inserted into the open cutter until its moth end touched the inside of the back wall, an optimal tip size will be removed.

The user may repeat this process to cut several cigars before the chamber is filled, and may thereby wait until most convenient to hold the cutter over a proper receptacle facing the through-hole downwardly, and press the actuator again, thereby opening the cutter to release the trapped tip(s).

It should be understood that while the invention has been shown and described with reference to the specific exemplary embodiment shown, various changes in form and detail may be made without departing from the spirit and scope of the invention, and that the invention should therefore only be limited according to the following claims, including all equivalent interpretation to which they are entitled.

I claim:

1. A cigar cutting apparatus comprising;

a body with a circular periphery having a front housing and a rear housing;

a left cutting blade assembly; and a right cutting blade assembly;

wherein the left and right cutting blade assemblies are movable relative to the body between an open state in which both blade assemblies are extended outwardly to allow a cigar end to be inserted there-between, and a closed state in which both blade assemblies are compressed inwardly against the cigar end to remove a cigar tip therefrom;

wherein the front housing has a cigar-receiving hole concentric with the circular periphery and the rear housing has a closed back wall extending across the hole; and wherein the closed back wall is a rest that is configured to limit the insertion of the cigar end to control the size of the removed cigar tip, and is configured to cooperate with one or both of the left and right cutting blade assemblies when in the closed state to receive and retain the removed cigar tip;

further comprising a chamber between one or both of the left and right cutting blade assemblies and the closed back wall during the closed state for receiving and retaining the cigar tip and a blade opening actuator and a scissors mechanism communicating between the actuator and the blade assemblies and adapted to retain the blade assemblies in the closed state and to selectably allow the blade assemblies to move to the open state;

wherein the blade assemblies are biased towards the open state;

wherein the scissors mechanism comprises a pair of links in an "X" arrangement pivotably affixed to the body, engageable by the actuator, and having lower pawl ends for engaging the blade assemblies;

and wherein the scissors mechanism is adapted such that actuation of the actuator allows the lower pawl ends to engage the blade assemblies and retain them in the closed state.

2. The cigar cutting apparatus of claim 1 wherein the blade assemblies include stops to be engaged by the lower pawl ends to retain the blade assemblies in the closed state.

3. The cigar cutting apparatus of claim 2 wherein each of the cutting blade assemblies comprises a curved beveled cutting edge.

4. A cigar cutting apparatus comprising;

a body with a circular periphery having a front housing and a rear housing;

a left cutting blade assembly;

a right cutting blade assembly;

a blade opening actuator; and a scissors mechanism;

wherein the left and right cutting blade assemblies are movable relative to the body between an open state in which both blade assemblies are extended outwardly to allow a cigar end to be inserted there-between, and a closed state in which both blade assemblies are compressed inwardly against the cigar end to remove a cigar tip therefrom;

wherein the scissors mechanism communicates between the actuator and the blade assemblies and is adapted to retain the blade assemblies in the closed state and to selectably allow the blade assemblies to move to the open state; and wherein the front housing has a cigar-receiving hole concentric with the circular periphery and the rear housing has a closed back wall extending across the hole; and wherein the closed back wall is a rest that is configured to limit the insertion of the cigar end to control the size of the removed cigar tip, and is configured to cooperate with one or both of the left and right cutting blade assemblies when in the closed state to receive and retain the removed cigar tip;

wherein the scissors mechanism comprises a pair of links in an "X" arrangement pivotably affixed to the body, engageable by the actuator, and having lower pawl ends for engaging the blade assemblies; and wherein the scissors mechanism is adapted such that actuation of the actuator allows the lower pawl ends to engage the blade assemblies and retain them in the closed state.

5. The cigar cutting apparatus of claim 4 further comprising a chamber between one or both of the left and right cutting blade assemblies and the closed back wall during the closed state for receiving and retaining the cigar tip.

* * * * *